United States Patent [19]

Flanagan

[11] 3,973,100

[45] Aug. 3, 1976

[54] SELF-LIMITING ELECTRIC HAIR CURLER HEATER

[75] Inventor: Charles D. Flanagan, Attleboro, Mass.

[73] Assignee: Texas Instruments Incorporated, Dallas, Tex.

[22] Filed: Dec. 27, 1972

[21] Appl. No.: 318,951

[52] U.S. Cl. ..... 219/222; 132/33 R; 132/39; 219/242; 219/505

[51] Int. Cl.[2] ..... H05B 1/00; A45D 2/36; A45D 4/16

[58] Field of Search ..... 219/222–226, 219/242, 505, 504; 132/33 R, 36, 33 F, 39

[56] References Cited

UNITED STATES PATENTS

| | | | |
|---|---|---|---|
| 2,861,163 | 11/1958 | Asakawa | 219/222 UX |
| 3,243,753 | 3/1966 | Kohler | 219/222 UX |
| 3,487,197 | 12/1969 | D'Elia et al. | 219/222 |
| 3,559,658 | 2/1971 | Genest et al. | 219/222 X |
| 3,581,055 | 5/1971 | Makino | 219/222 |

*Primary Examiner*—A. Bartis
*Attorney, Agent, or Firm*—John A. Haug; James P. McAndrews; Russell E. Baumann

[57] ABSTRACT

A heated hair curler has a fast warm-up time and a slow cool down time due to a heater element having a steeply sloped positive temperature coefficient (PTC) of resistivity. The heater is composed of a ceramic like material such as doped barium titanate or a polymer loaded with conductive particles such as polyethylene loaded with carbon black. In one embodiment the heater is shaped in the form of an elongated annulus to fit closely inside a hollow plastic curler shell. Conductive coatings located on the inner and outer peripheral surfaces mate with ring shaped conductors supported in a base. In a second embodiment the PTC heating element which may be in the form of a parallelopiped is located within a sealed cylindrical container, also containing a fusible wax, which in turn fits within the hollow plastic curler shell. The PTC element has conductive coatings on two opposite faces for electrical connection thereto.

4 Claims, 3 Drawing Figures

SELF-LIMITING ELECTRIC HAIR CURLER HEATER

RELATED APPLICATIONS

This is a continuation of application Ser. No. 194,368, filed Nov. 1, 1971, now abandoned, which is a division of application Ser. No. 6,088 filed Jan. 27, 1970, which issued on Jan. 4, 1972 as U.S. Pat. No. 3,632,971.

BACKGROUND OF THE INVENTION

The invention relates to hair curlers and more particularly to electrically heated hair curlers.

Electrically heated hair curlers have found wide market acceptance in recent years. In general, these curlers comprise an outer cylindrical shell of a suitable polymer provided with a plurality of fingers extending outwardly from the outer peripheral surface of the shell for grasping hair wound about the shell. One type of curler employing these curlers are heated to a desired temperature, then taken by the user who trains hair about the periphery. The hair is generally kept in contact with the curler for a short period of time to effect curling of the hair. Various ways have been used to heat the curlers but all have certain disadvantages. One type of curler employs, mounted within the shell, a housing which contains a fusible wax. The curler is placed in heat transfer relation with a heating element until the wax melts and is then removed from the heat source and is ready for use. However, since the wax is changed to a liquid, special precautions must be taken to insure a good seal. Further, the time which is required for the curler to be heated is longer than desirable due to the relatively low heat conductivity of the wax. The wax-filled device offers the advantage of being an excellent heat storage means due to the latent heat released during phase change of the wax from liquid to solid upon cooling. Attempts have been made to avoid these disadvantages by using a resistance element in the curler both in the heater and in the heat storing means. This avoids the liquid sealing problem but the warm-up time for the device time is still excessive since a relatively massive resistance element must be employed in order to store the heat for the required time after de-energization. Both of the above types require current controlling devices, such as thermostats. Further, heat distribution along the surface of the curler for both types is relatively non-uniform with a concomitant non-uniform degree of curling for different sections of hair.

Thus it is an object of the invention to obviate the disadvantages of the prior art curlers mentioned above.

Another object of the invention is the provision of a hair curler heater which combines the functions of various components used in prior art devices.

Yet another object is the provision of a simple, reliable, rugged hair curler device, one which provides uniform heating with no hot or cold spots. Another object is the provision of a hair curler heater which has an extremely fast warm-up time along with maintaining its heat for a prolonged period. Yet another advantage is the provision of a hair curler device which needs no thermostats and provides close temperature control.

Other objects and features will be in part apparent and in part pointed out hereinafter.

Briefly, the invention meets the above objects by providing a heat storage means mounted within a hair curler shell in close heat transfer relation with the shell, the heat storage means including a heating element which has a steeply-sloped PTC at temperatures above an anomaly. In one embodiment the heat storage means and the heating element are formed from the same element, an elongated annulus which is coated on the inner and outer peripheral surfaces with a conductive electrode material. The coatings are heavier adjacent one end of the annulus to facilitate electrical connection thereto. A base is provided which contains two upstanding, slightly conical, ring-shaped conductors which mate with the respective thicker portions of the inner and outer coatings. In a second embodiment electrically conductive leads electrically connect and physically mount the heater within a sealed container, also containing a fusible wax, which container in turn fits closely inside the curler shell.

In the accompanying drawings, in which several of the various possible embodiments of the invention is illustrated:

Figure 1:
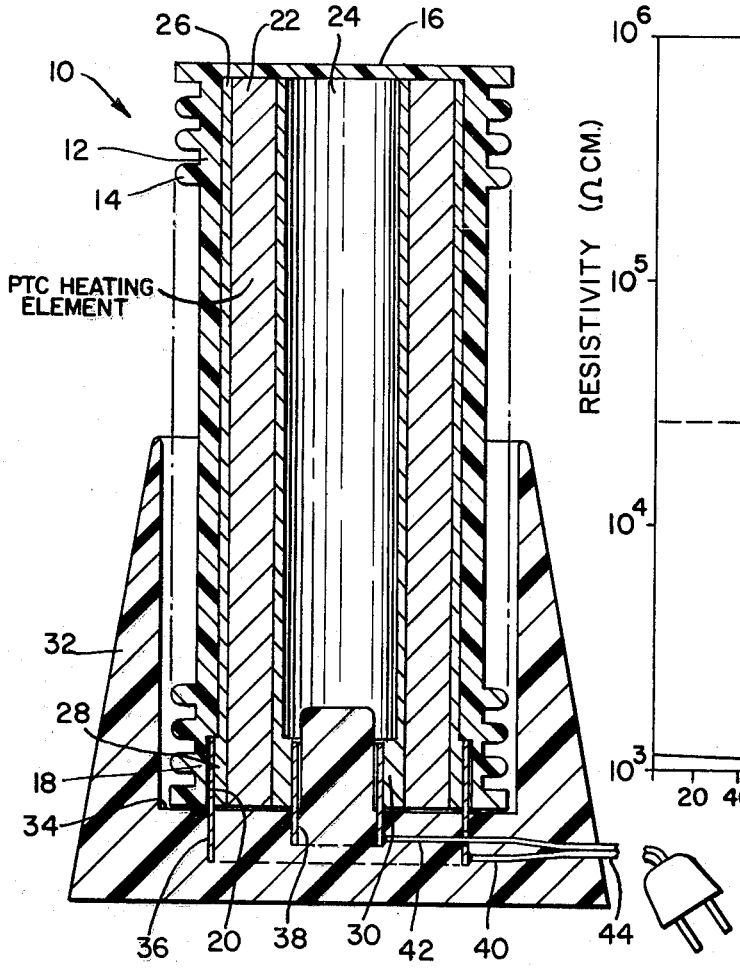
FIG. 1 is a cross section of a hair curler device made in accordance with the invention.

Dimensions of certain of the parts as shown in the drawings may have been modified and/or exaggerated for the purposes of clarity of illustration.

The invention accordingly comprises the elements and combinations of elements, features of construction, and arrangements of parts which will be exemplified in the structures hereinafter described, and the scope of the application of which will be indicated in the following claims.

Figure 2:
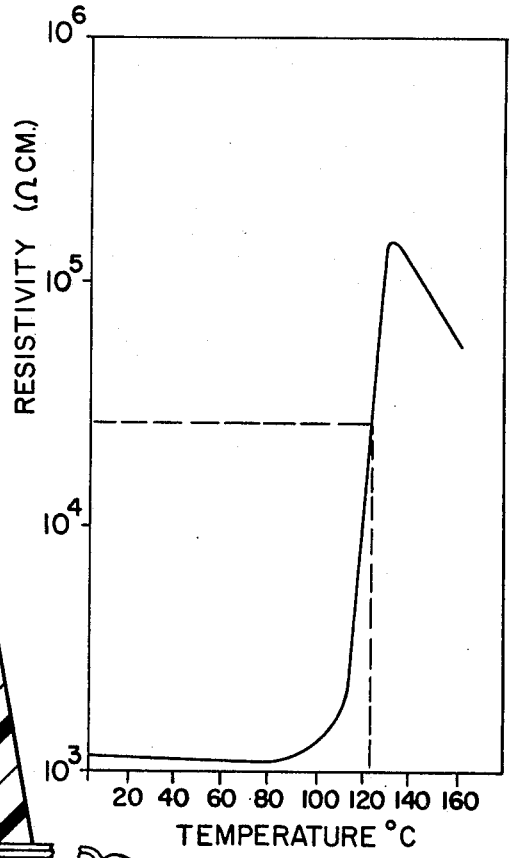
FIG. 2 shows a curve for resistivity plotted against temperature for a heater element made in accordance with the invention.

The heater of the present invention is made out of conductive filled polymer having a positive temperature coefficient of resistance above an anomaly or threshold temperature. The heater is connected to line voltage so that current flows therethrough causing $I^2R$ heating. When the temperature rises above the anomaly point, there is a sudden and marked increase in resistance to effectively cut off the current through the heater, as is clearly seen in FIG. 2. Thus, this self-limiting permits high initial power input and fast warm-up but eliminates the need for a thermostat or similar control employed by prior art devices. Among the other advantages the present invention offers is that extremely fast warm-up time is obtained while storing the heat for an extended period of time since the polymer acts as a heater, heat exchanger and heat storage medium. Due to the sharp rise in resistance at temperatures above the anomaly temperature, a PTC material, either polymer, such as carbon black loaded polyethylene, or ceramic, such as a doped barium-titanate, is used with a low basal resistivity to maximize heat generation during the warming-up stage.

Referring now to the drawings, and particularly FIG. 1, numeral 10 indicates generally a hair curler made in accordance with the invention. A cylindrical shell of any suitable polymeric material is formed with a plurality of fingers 14 extending therefrom to facilitate holding of hair thereon. Shell 12 is preferably formed with closed end 16 and open end 18. End 18 is formed with a recessed annulus area 20 to permit reception of a terminal member described below. An elongated annulus 22 formed of a material having as a characteristic a steeply-sloped positive temperature coefficient (PTC) of resistance at temperatures above an anomaly temperature and having a generally uniform low resistance at temperatures below the anomaly temperature. Such materials are known in the art, either a ceramic type such as barium-titanate doped with rare earth $Ba_{.003}$ $La_{.997}$ $TiO_3$, or a polymer, such as polyethylene loaded with conductive particles of carbon black. Annulus 22, which serves as the heating element for the hair curler, is provided with electrically conductive coatings 24, 26 on the inner and outer peripheral surfaces respectively. If heater element 22 is constructed out of a ceramic material, the conductive coatings could be applied by ultrasonic soldering or flame spraying. If element 22 is formed of a polymer, the coating can be applied by catalytic electroless nickel deposition, as set forth in copending, coassigned application Ser. No. 6,093, filed Jan. 27, 1970, now abandoned. It will be noted that adjacent one end of annulus 22, both coatings 24 and 26 are somewhat thicker as at 28 and 30 and recessed areas are provided adjacent thereto, to facilitate making electrical contact with the base terminals. The outer diameter of annulus 22 is chosen so that a tight fit exists between the annulus and the outer shell to enhance heat flow between the heater and the outer surface of shell 12.

Base 32 of any suitable electrical insulating material, such as bakelite, is formed with a recessed seat area 34 to prevent the user from accidentally contacting both terminals and receiving an electrical shock, and has placed in the base, as by molding therein, two concentric ring-like terminals 36, 38 which extend above the surface of the base. Open end 18 of curler 10 is adapted to be received in seat 34 with terminals 36, 38, making sliding electrical contact with terminal areas 28, 30 respectively. Terminal rings 36, 38 are preferably formed so as to provide spring action or provided with a very slight conical shape, the imaginary apex of 36 being in the direction toward the bottom of FIG. 1, with imaginary apex of 38 being in the direction toward the top of the Figure. This insures optimum electrical contact even if there are slight differences in the sizes of various curlers. Electrical connection is effected to ring terminals 36, 38 in a conventional manner, as by soldering leads 40, 42 of line cord 44, as shown.

Figure 3:
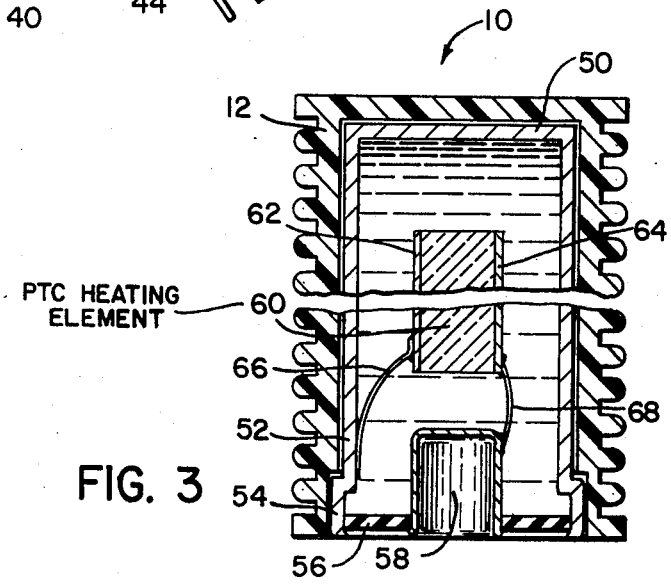
FIG. 3 shows a cross section of a hair curler according to an alternative embodiment of the present invention.

In FIG. 3 there is shown an alternative embodiment in which hair curler 10' formed of shell 12 as in FIG. 1 embodiment, receives therein a sealed cylindrical container 50 constructed out of electrically and thermally conductive material and formed with an open end 52. Terminal portion 54, corresponding to terminal 28 of the FIG. 1 embodiment, is formed on the outer end 52 of the container and then is crimped over electrically insulating disc 56. A cup shaped terminal 58 constructed out of electrically conductive material is placed in a central aperture formed in disc 56 and is analogous to terminal 30 of the FIG. 1 embodiment. Terminals 54, 58 may be plated with a highly conductive material if it is desired to improve the electrical connection to the curler heater. Placed within container 50 is a heating element 60 formed for instance as a parallelopiped of PTC material of the same type used for annulus 22 of FIG. 1. Conductive coatings 62, 64 are placed on two opposite faces of element 60 in the same manner as the conductive coatings applied to annulus 22 in the FIG. 1 embodiment. Lead 66 is attached by conventional means, such as soldering, to container 50 and coating 62 while lead 68 connects terminal 58 to coating 64 in like manner. Placed within container 50 along with heating element 60 is a fusible wax which serves as the heat exchanger and storage medium. The self-limiting PTC heater permits for rapid warm-up due to the low base resistivity, while the wax is used in prior art devices to store latent heat to extend the cooling time. The anomaly temperature of the PTC element is chosen so that it is slightly above the transition temperature at which the wax melts.

It will be seen that one of the advantages that both embodiments offer is that due to the very rapid warm-up time, in the order of 5–30 seconds, a base with a single seat with electrical connection for a heating station may be employed, thus requiring much less space than prior art devices which required a whole series of such heating stations due to the long warm-up time of ten minutes or more. The user can be training her hair about a heater curler and by the time she is finished, the one placed in seat 34 is ready for use.

In view of the above, it will be seen that the several objects of the invention are achieved and other advantageous results attained.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the true spirit and scope of the invention.

I claim:

1. An electrically heated hair curler comprising a generally cylindrical outer shell, a sealed container closely fitting into the outer shell, a heating element which has a steeply-sloped positive temperature coefficient of resistance at temperatures above an anomaly temperature mounted within the container, fusible wax heat storage means disposed within the container in heat transfer relation with the shell and substantially filling the space between the container and the heating element, and means for making electrical connection with the element, the container being generally cylindrical in shape and being formed of electrically conductive material with an open end, the open end being exposed to form a terminal, an electrically insulative disc having an aperture therein and being received in the open end of the container and being sealingly crimped thereto, a cup-shaped terminal of electrically conductive material being received in the disc aperture, the heater being formed of a ceramic type material and having a pair of spaced electrically conductive coatings thereon, and the means for making electrical connection with the element comprising electrically conductive leads electrically joining one of the coatings to the container and the other coating to the cup shaped terminal and physically supporting the heater within the container.

2. An electrically heated hair curler as defined in claim 1 in which the heating element is formed of doped barium titanate.

3. An electrically heated hair curler as defined in claim 1 in which the heating element is generally parallelopiped in shape.

4. An electrically heated hair curler as defined in claim 1 in which the fusible wax has a transition temperature at which the wax melts, the anomaly temperature of the heating element being above the wax transition temperature.

* * * * *